US007901181B1

(12) United States Patent
Liang

(10) Patent No.: US 7,901,181 B1
(45) Date of Patent: Mar. 8, 2011

(54) TURBINE BLADE WITH TRIPLE SPIRAL SERPENTINE FLOW COOLING CIRCUITS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 979 days.

(21) Appl. No.: 11/799,640

(22) Filed: May 2, 2007

(51) Int. Cl.
*F01D 5/08* (2006.01)

(52) U.S. Cl. ..... 416/97 R

(58) Field of Classification Search ..... 415/115; 416/97 R

See application file for complete search history.

(56) References Cited

U.S. PATENT DOCUMENTS 5,165,852 A 11/1992 Lee et al.
5,356,265 A 10/1994 Kercher
5,538,394 A * 7/1996 Inomata et al. ..... 416/97 R
5,667,359 A * 9/1997 Huber et al. ..... 416/96 A
5,813,835 A * 9/1998 Corsmeier et al. ..... 416/97 R
6,595,748 B2 * 7/2003 Flodman et al. ..... 416/97 R
6,705,836 B2 3/2004 Bourriaud et al.
6,916,155 B2 * 7/2005 Eneau et al. ..... 416/97 R
7,097,426 B2 * 8/2006 Lee et al. ..... 416/97 R
7,296,973 B2 * 11/2007 Lee et al. ..... 416/97 R
7,303,376 B2 * 12/2007 Liang ..... 416/96 R
7,568,887 B1 * 8/2009 Liang ..... 416/97 R
7,581,927 B2 * 9/2009 Cunha ..... 416/96 R
7,611,330 B1 * 11/2009 Liang ..... 416/97 R

* cited by examiner

*Primary Examiner* — Edward Look
*Assistant Examiner* — Aaron R Eastman
(74) *Attorney, Agent, or Firm* — John Ryznic

(57) ABSTRACT

A turbine blade with a cooling circuit that includes three separate 3-pass serpentine flow cooling circuits that each flow in the aft direction of the blade. Each of the three 3-pass serpentine circuits includes a first leg on the pressure side of the blade with a row of film cooling holes to discharge cooling air to the pressure side surface of the blade. The first and the second 3-pass serpentine circuits each include second and third legs located on the suction side of the blade, and the third legs include a row of film cooling holes to discharge cooling air onto the suction side wall surface. The third 3-pass serpentine circuit includes a second leg on the suction side and a third leg aft of the first and second legs and positioned between both the pressure side and suction side walls. Cooling air for a leading edge cavity and showerhead arrangement is supplied from the first leg of the first 3-pass serpentine circuit. The third leg of the third 3-pass serpentine circuit includes a row of exit holes to discharge cooling air out the trailing edge of the blade.

4 Claims, 3 Drawing Sheets

Fig. 1 Typical 1st Blade External Pressure Profile

TURBINE BLADE WITH TRIPLE SPIRAL SERPENTINE FLOW COOLING CIRCUITS

CROSS-REFERENCE TO RELATED APPLICATIONS

This application is related to co-pending U.S. patent application Ser. No. 11/503,547 filed on Aug. 11, 2006 by Liang and entitled COMPARTMENT COOLED TURBINE BLADE; and co-pending U.S. patent application Ser. No. 11/453,361 filed on Jun. 14, 2006 by Liang and entitled TURBINE BLADE WITH BIFURCATED COUNTER FLOW SERPENTINE PATH; and co-pending U.S. patent application Ser. No. 11/600,448 filed on Nov. 16, 2006 by Liang and entitled TURBINE BLADE WITH A SERPENTINE FLOW AND IMPINGEMENT COOLING CIRCUIT; and co-pending U.S. patent application Ser. No. 11/584,479 filed on Oct. 19, 2006 by Liang and entitled TURBINE BLADE WITH TRIPLE PASS SERPENTINE FLOW COOLIG CIRCUIT.

BACKGROUND OF THE INVENTION

1. Field of the Invention

The present invention relates generally to fluid reaction surfaces, and more specifically to a turbine blade with an internal cooling air circuit.

2. Description of the Related Art including information disclosed under 37 CFR 1.97 and 1.98

A gas turbine engine includes a turbine section with a plurality of stages of turbine blades to extract mechanical energy from a hot gas flow produced within a combustor. The efficiency of the engine can be increased by passing a higher temperature flow into the turbine. Modern turbine airfoil materials allow for only a maximum temperature without damaging the airfoils. To increase the temperature of the flow, complex cooling circuitry have been proposed to provide for both internal convection cooling of the airfoils and film cooling to provide a layer of film cooling air over the external surface of the airfoil to add protection against the high temperature gas flow.

The efficiency of the engine can also be increased by minimizing the amount of cooling air used to cool these airfoils. Compressed air from the compressor of the engine is drawn off and passed through the turbine airfoils for use in cooling. Less less cooling air from the compressor increases the efficiency of the engine because more of the compressed air can be passed into the combustor to produce the hot gas flow. Thus, turbine airfoil designers attempt to minimize the amount of compressed cooling air used to cool the airfoils while providing the highest amount of cooling capability with the minimal amount of cooling air.

FIG. 1 shows the external pressure profile on a prior art turbine blade used in an aero engine. The highest external airfoil pressures are located on the pressure side of the blade as seen from the top line in FIG. 1. The suction side of the blade past the vertical dashed line in this figure shows a low pressure area.

FIG. 3 shows a prior art turbine blade having a 1+5+1 serpentine flow cooling circuit used to cool a first stage turbine blade. The cooling circuit includes a leading edge cooling supply channel 11 and a leading edge impingement channel 12 to provide cooling for the leading edge region of the blade. A showerhead arrangement of film cooling holes 13 connected to the impingement channel 12 provides film cooling for the leading edge surface of the blade.

The trailing edge region of the blade is cooled by a circuit that includes a trailing edge cooling supply channel 15 with double impingement cooling channels 16 and 17 located downstream from the supply channel 15. Film cooling holes 18 connected to the supply channel 15 and trailing edge exit holes or slots 19 discharge cooling air from the impingement channel 17 out through the trailing edge of the blade.

The area of the blade between the leading edge and the trailing edge regions is cooled by a 5-pass serpentine flow cooling circuit that flows in the forward direction. This 5-pass serpentine flow circuit includes a first leg 21 that is the cooling supply channel for the 5-pass circuit, a second leg 22, a third leg 23, a fourth leg 24 and a fifth leg 25 that flows in series along the serpentine flow path from the leading edge end to the trailing edge end. The first leg 21 is an up-pass channel and includes a row of film cooling holes discharging on the pressure side of the blade. The second leg 22 is a down pass channel and includes a row of film cooling holes discharging on the pressure side of the blade. The third leg 23 is an up-pass channel, and includes two rows of film cooling holes to discharge film cooling air onto the pressure side and the suction side of the blade. The fourth leg is a down-pass leg, and includes a row of film cooling holes to discharge cooling air onto the pressure side of the blade. The fifth leg is an up-pass channel, and includes two rows of film cooling holes to discharge film cooling air onto the pressure side and the suction side of the blade.

In the prior art turbine blade cooling circuit of FIG. 3, cooling air is supplied to three separate channels of the blade as seen by the diagram of FIG. 4 representing the cooling flow paths. This forward flowing 5-pass serpentine circuit is used in the airfoil mid-chord region. The cooling air flows in the forward direction (from leading edge to trailing edge) and discharges into the high hot gas side pressure section of the pressure side. In order to satisfy the back flow margin criteria, a high cooling supply pressure is needed for this particular design, and thus inducing a high leakage flow. If a single channel includes film cooling holes on both sides of the airfoil, such as the third and fifth leg channels 23 and 25, and because the external pressure profile on the suction side has a lower pressure than on the pressure side, an excess pressure ratio across the suction side row of film cooling holes is developed.

Because the second and third up-pass channels (channels 23 and 25) of the 5-pass serpentine flow circuit provides film cooling air for both sides of the blade, in order to satisfy the back flow margin criteria for the pressure side film row, the internal cavity or channel pressure has to be approximately 10% higher than the pressure side hot gas side pressure which will result in over-pressuring the airfoil suction side film holes.

U.S. Pat. No. 5,813,835 issued to Corsmeier et al Sep. 29, 1998 and entitled AIR-COOLED TURBINE BLADE discloses an air cooled gas turbine blade with one serpentine cooling passage on a pressure side of the airfoil, a second serpentine passage on the suction side, and a third serpentine passage disposed in the middle of the airfoil. Film cooling holes on the last leg of the passages discharge cooling air from the blade. The present invention differs from the Corsmeier patent in that the three serpentine passages in the present invention all have a first leg on the pressure side of the blade, and also the second legs of the passages move to the other side of the blade on the suction side.

The U.S. Pat. No. 5,538,394 issued to Inomata et al on Jul. 23, 1996 and entitled COOLED TURBINE BLADE FOR A GAS TURBINE discloses (in FIG. 1 of Inomata) a turbine blade with three separate serpentine flow passages or circuits within the blade. A first 3-pass serpentine circuit includes a first leg on the pressure side, and a second and third leg on the suction side and adjacent to each other. Film cooling holes connect the third leg to the suction side surface of the blade. The second serpentine circuit is a 5-pass serpentine circuit having a first leg on the pressure side, a second leg on the suction side, a third leg on the pressure side, a fourth leg on the suction side, and a fifth leg on the suction side and adjacent to the fourth leg. Film cooling holes are connected to the fifth leg to discharge the cooling air. The third serpentine circuit is in the trailing edge region and includes a 3-pass serpentine circuit with each channel or leg extending between both the pressure side and suction side walls such that the legs do not alternate between sides. A separate leading edge cooling supply channel supplies cooling air to the leading edge cooling cavity and showerhead holes.

The Inomata cooling circuit requires more flow than the present invention because separate supply channels are required for the leading edge cooling circuit and the first serpentine circuit in the mid-chord region. In the cooling circuit of the present invention, the first leg of the serpentine circuit also supplies cooling air to the leading edge cooling cavity and showerhead holes. In the Inomata cooling circuit, the cooling supply channel for the leading edge region would produce a low mach number in the flow because of the narrowing channel toward the blade tip and the loss of flow as cooling air is metered off through the metering holes and into the leading edge cavity and showerhead holes. Also, the leading edge supply channel extends between both the pressure side and the suction side walls, and film cooling holes are located on both sides of the channel. The same pressure exists within the channel to discharge cooling air through the suction side film cooling holes as does the pressure side film cooling holes. In the cooling circuit of the present invention, the pressure side film cooling holes are connected to a different channel than are the suction side film cooling holes.

It is an object of the present invention to provide for a turbine blade with a serpentine flow cooling circuit that will optimize the use of the main stream pressure gradient.

It is another object of the present invention to provide a turbine blade with three separate 3-pass serpentine aft flowing cooling circuits.

BRIEF SUMMARY OF THE INVENTION

A turbine blade having three separate triple pass (3-pass) serpentine aft flow cooling circuits that will optimize the use of the main stream pressure gradient. At the blade forward portion, a triple pass aft flowing spiral serpentine circuit provides cooling for the pressure side and the suction side of the airfoil and also provides the cooling air for the airfoil leading edge impingement cooling. the aft flowing serpentine cooling flow circuit with a first up-pass channel on the airfoil pressure side will maximize the use of cooling to main stream gas side pressure potential as well as tailoring the airfoil external heat load. The cooling air is supplied at the airfoil pressure side where the airfoil heat load is low, eliminating the use of film cooling. Cooling air then flows in a serpentine path across the blade tip section to provide cooling for the blade squealer tip and then down the second leg of the spiral serpentine channel on the airfoil suction side and then serpentines through the third leg of the serpentine path on the airfoil suction side surface. The spent cooling air is discharged at the aft section of the airfoil where the gas side pressure is low and thus yields a high cooling air to main stream pressure potential to be used for the serpentine channels and maximize the internal cooling performance for the serpentine. In addition, this approach yields a lower cooling supply pressure requirement and lower leakage flow. This process is repeated for the mid-chord triple serpentine flow circuit and the trailing edge triple pass serpentine flow circuit.

DETAILED DESCRIPTION OF THE INVENTION

Figure 1:
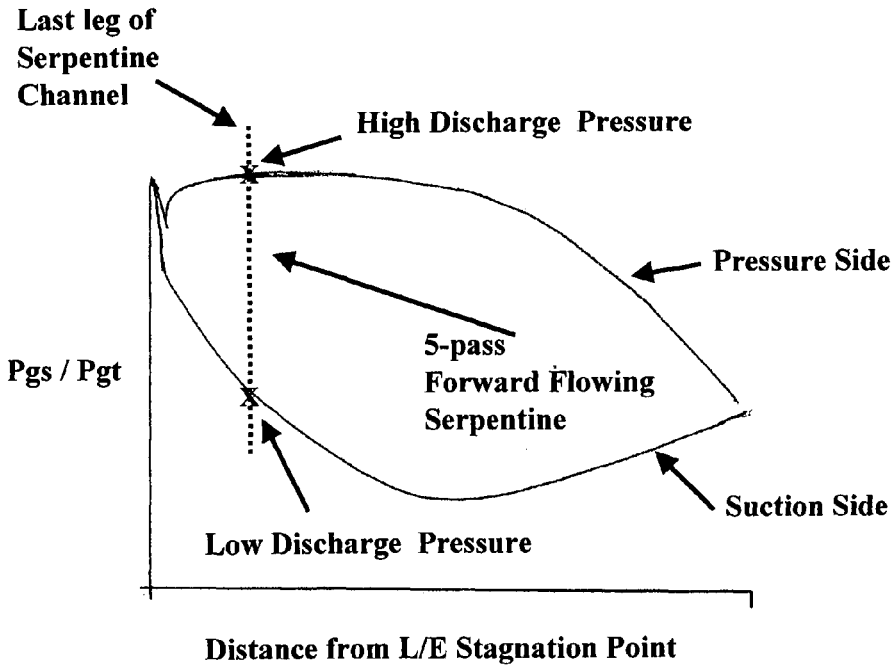
FIG. 1 shows an external pressure profile of a prior art first stage turbine blade.
Figure 2:
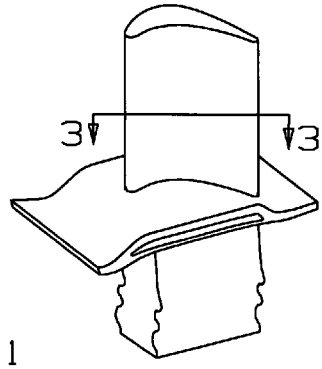
Fig 2 Prior Art
FIG. 2 shows a schematic view of a prior art first stage turbine blade.
Figure 3:
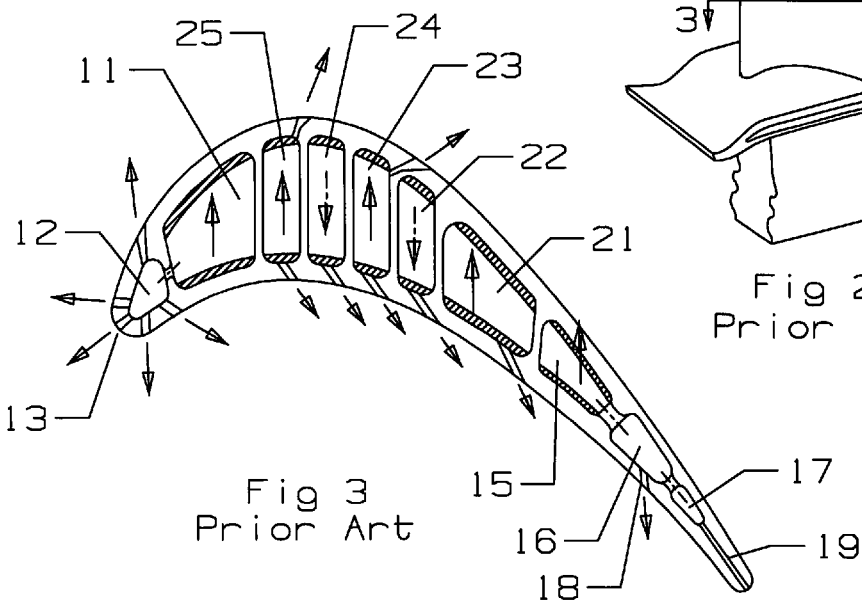
Fig 3 Prior Art
FIG. 3 shows a cross section view of the cooling circuit for the first stage turbine blade of FIG. 2.
Figure 4:
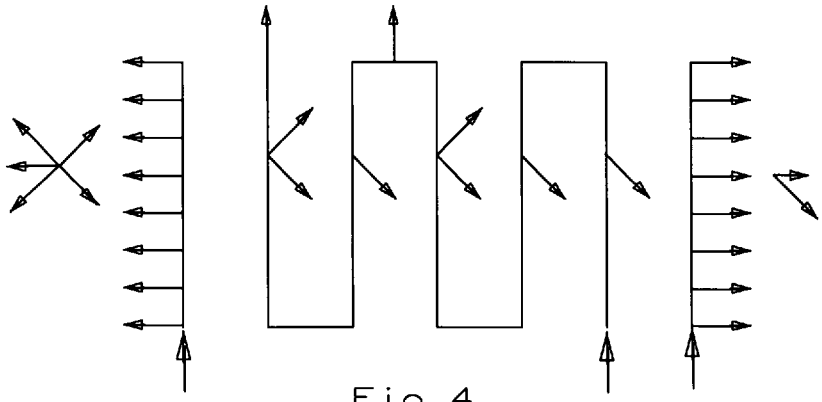
Fig 4 Prior Art
FIG. 4 shows diagram of the cooling flow path in the first stage turbine blade of FIG. 1.
Figure 5:
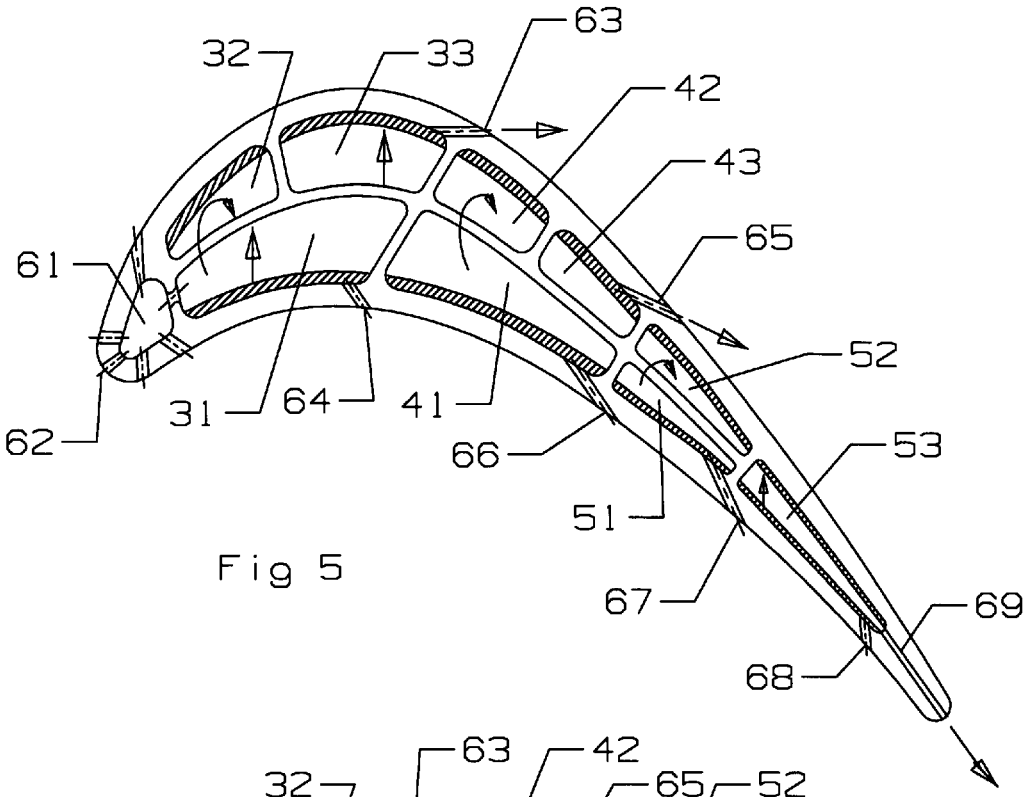
FIG. 5 shows a cross section view of the cooling circuit of the present invention.

The present invention is a serpentine flow cooling circuit for a turbine blade used in an aero engine. However, the cooling circuit design can also be applied to an industrial gas turbine engine. The rotor blade is shown in FIG. 5 with three separate three-pass serpentine flow cooling circuits. The first three-pass serpentine flow circuit cools the leading edge region, the second three-pass serpentine flow circuit cools the mid-chord region, and the third three-pass serpentine circuit cools the trailing edge region. Each of the three 3-pass serpentine circuits are supplied from a common source of pressurized cooling air such as that from the compressor in the engine.

The first 3-pass serpentine circuit includes a first leg channel 31 located on the pressure side that is also the cooling air supply channel for the circuit. A second leg channel 32 located on the suction side of the blade is a down-pass channel. The third leg channel 33 is located on the suction side and adjacent to the second leg 32. A leading edge impingement cavity 61 with a showerhead arrangement of film cooling holes 62 is connected to the first leg channel 31 supply channel through a row of metering holes formed in the rib separating the first leg channel 31 from the cavity 61. The first leg channel 31 and the third leg channel 33 both have a row of film cooling holes 64 and 63 to discharge film cooling air from the channel to the airfoil surface.

The second 3-pass serpentine circuit includes a first leg channel 41 located on the pressure side that is also the cooling air supply channel for the second 3-pass circuit. A second leg channel 42 is located on the suction side and is connected to the first leg channel 41. The third leg channel 43 is located on the suction side and adjacent to the second leg channel 42. The first leg channel 41 and the third leg channel 43 both have a row of film cooling holes 66 and 65 to discharge film cooling air from the channel to the airfoil surface.

The third 3-pass serpentine circuit includes a first leg channel 51 located on the pressure side that is also the cooling air supply channel for the second 3-pass circuit. A second leg channel 52 is located on the suction side and is connected to the first leg channel 51. The third leg channel 53 is located on the suction side and adjacent to the second leg channel 52. The first leg channel 51 and the third leg channel 53 both have a row of film cooling holes 67 and 68 to discharge film cooling air from the channel to the airfoil surface. A row of trailing edge exit holes or slots 69 also connect the third leg channel 53 to discharge cooling air out through the leading edge of the blade.

Figure 6:
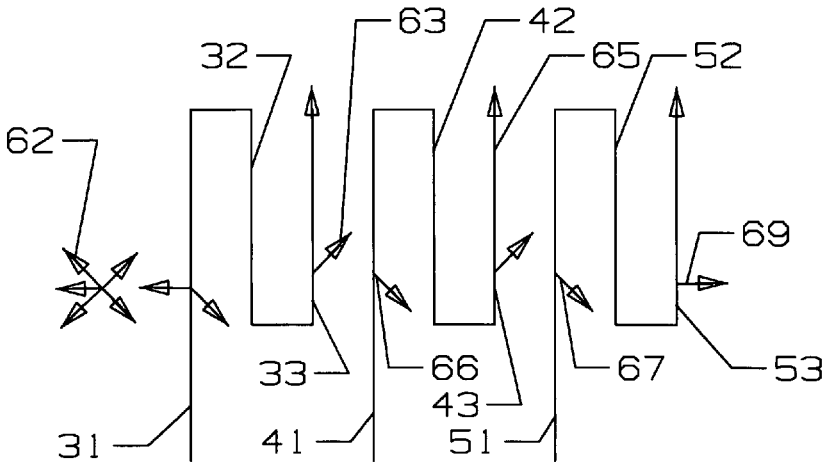
FIG. 6 shows a diagram of the cooling flow path in the cooling circuit of the present invention of FIG. 5.

In each of the three 3-pass serpentine circuits described above, pressurized cooling air is supplied to the first leg cooling supply channel and flows in the up direction from the root to the blade tip, flows across the blade tip and down into the second leg channel, and then into the third leg channel in the up direction. Some of the cooling air is bled off into the film cooling holes that are connected with a certain channel such as the impingement cavity 61, film cooling holes (63, 64,65,66,67,68), and the exit cooling holes 69 to provide further cooling for the blade. FIG. 6 shows a diagram view of the cooling air paths through the blade of FIG. 5.

Some design features and advantages of the cooling circuit of the present invention over the cited prior art blade are described below. The triple aft flowing spiral serpentine blade cooling design sub-divides the blade into three separate zones that includes the blade leading edge region, the blade mid-chord section, and the blade trailing edge region. Each individual cooling circuit can be independently designed based on the local heat load and aerodynamic pressure loading conditions. The aft flowing spiral serpentine initiated at the airfoil pressure side surface and ending at the aft portion of the airfoil suction surface or airfoil trailing edge, and thus lowers the required cooling supply pressure and reduces the overall blade leakage flow. The circuit sub-divides the blade into three different zones to increase the design flexibility to redistribute cooling flow and/or add cooling flow for each zone, and thus increasing growth potential for the cooling design. Separate cooling supply cavities are used for the pressure side film row and suction side film row, and thus eliminates the blade serpentine cooling flow circuit mal-distribution due to film cooling flow mal-distribution, film cooling hole size, and mainstream pressure variation. High aspect ratio flow channels are used in the cooling circuit of the present invention. This improves the reducibility of the ceramic core, makes it easier to install film cooling holes, minimizes the rotational effects on internal heat transfer coefficient, and increases the internal convective area to hot gas side area ratio. The pressure side film row is separated from the suction side film row, and thus eliminates the design issues such as the back flow margin (BFM) and high blowing ratio for the blade suction side film cooling holes.

I claim the following:

1. A turbine rotor blade comprising:

a leading edge and a trailing edge;

a pressure side wall and a suction side wall extending between the leading edge and the trailing edge;

a first triple pass serpentine flow cooling circuit located in a forward section of the blade and having a first leg located against the pressure side wall and a second and third legs located against the suction side wall, the first leg being connected to a first row of film cooling holes that open onto the pressure side wall;

a second triple pass serpentine flow cooling circuit located in a middle section of the blade and having a first leg located against the pressure side wall and a second and third legs located against the suction side wall, the first leg being connected to a second row of film cooling holes that open onto the pressure side wall; and, a third triple pass serpentine flow cooling circuit located in an aft section of the blade and having a first leg located against the pressure side wall and a second and third legs located against the suction side wall, the first leg being connected to a third row of film cooling holes that open onto the pressure side wall;

a row of exit holes opening along the trailing edge of the blade and connected to the third leg of the third triple pass serpentine flow cooling circuit; and, the third leg of the third triple pass serpentine flow cooling circuit is connected to a row of film cooling holes that open onto the pressure side wall of the blade.

2. The turbine rotor blade of claim 1, and further comprising:

the third legs of the first and second triple pass serpentine flow cooling circuits both include a row of film cooling holes that open onto the suction side wall of the blade.

3. The turbine rotor blade of claim 1, and further comprising:

a row of exit holes opening along the trailing edge of the blade and connected to the third leg of the third triple pass serpentine flow cooling circuit.

4. The turbine rotor blade of claim 1, and further comprising:

a leading edge impingement cooling cavity located along the leading edge of the blade;

a showerhead arrangement of film cooling holes connected to the leading edge impingement cavity and opening onto the surface of the leading edge of the blade; and, a row of metering holes connecting the first leg of the first triple pass serpentine flow cooling circuit to the leading edge impingement cavity.

* * * * *